US005113682A

United States Patent [19]

Poloni

[11] Patent Number: 5,113,682

[45] Date of Patent: May 19, 1992

[54] CARTRIDGE ROLLING STAND

[75] Inventor: Alfredo Poloni, Fogliano di Redipuglia, Italy

[73] Assignee: Danieli & C. Officine Meccaniche S.p.A., Buttrio, Italy

[21] Appl. No.: 506,820

[22] Filed: Apr. 10, 1990

[30] Foreign Application Priority Data

Apr. 28, 1989 [IT] Italy ..... 83391 A/89

[51] Int. Cl.[5] ..... B21B 31/02; B21B 31/08

[52] U.S. Cl. ..... 72/237; 72/238

[58] Field of Search ..... 72/237, 238, 239, 250

[56] References Cited

U.S. PATENT DOCUMENTS

| | | | |
|---|---|---|---|
| 1,089,126 | 3/1914 | Grey | 72/238 |
| 3,935,722 | 2/1976 | Bock | 72/250 |
| 3,946,798 | 3/1976 | Uchimoto et al. | 72/237 |
| 4,368,633 | 1/1983 | Nogota | 72/239 |
| 4,471,642 | 9/1984 | Wilson | 72/238 |
| 4,653,304 | 3/1987 | Feldmann et al. | 72/239 |
| 4,686,845 | 8/1987 | Svagr | 72/238 |
| 4,866,969 | 9/1989 | Reismann et al. | 72/238 |

FOREIGN PATENT DOCUMENTS

| | | | |
|---|---|---|---|
| 19238 | 11/1980 | European Pat. Off. . | |
| 40584 | 11/1981 | European Pat. Off. . | |
| 65935 | 12/1982 | European Pat. Off. | 72/238 |
| 302254 | 2/1989 | European Pat. Off. . | |
| 7705580 | 12/1977 | Fed. Rep. of Germany . | |
| 2918807 | 11/1980 | Fed. Rep. of Germany | 72/238 |
| 255208 | 12/1985 | Japan . | |
| 8806930 | 9/1988 | PCT Int'l Appl. . | |

OTHER PUBLICATIONS

Danieli Company Brochure, "Cartridge Stands", No. 2000.03.86, Mar. 1986, pp. 1–8.

*Primary Examiner*—Lowell A. Larson
*Assistant Examiner*—Thomas C. Schosffler
*Attorney, Agent, or Firm*—Antonelli, Terry, Stout & Kraus

[57] ABSTRACT

Two-high horizontal cartridge rolling stand (10) which comprises an assembly (12) including rolls, chocks and adjustment means arranged between a first end structure (13) and a second end structure (14) of the stand, the first and second end structures (13–14) being connected together laterally below the rolls by a central stiffening body (15), the first end structure (13) of the stand being permanently connected in a rigid and substantially stable manner to the central body (15), whereas the second end structure (14) of the stand is equipped with releasable fixture means able to provide momentary rigid and substantially stable connection of the second end structure (14) to the central body (15), the first end structure (13) of the stand also constraining the chocks in a direction lengthwise to the rolling rolls.

5 Claims, 1 Drawing Sheet

CARTRIDGE ROLLING STAND

This invention concerns an improved cartridge rolling stand for rolls with a horizontal axis. To be more exact, the invention concerns a two-high horizontal cartridge rolling stand without a containment support.

Two-high horizontal cartridge rolling stands 10 are stands consisting of two elements; these two elements are two containment supports 11 positioned at the sides of the operational bed of the rolls and two pairs of assemblies 12 of chocks, rolls and adjustment means that cooperate with the containment supports 11 respectively.

The containment supports 11 serve to position the pairs of assemblies 12 and form an intermediate element between the bedplate and the assemblies 12.

Figure 1:
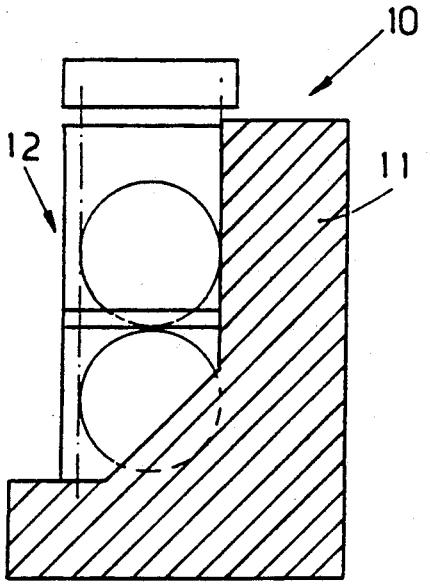
fig. 1 PRIOR ART

FIG. 1 gives a side view of a rolling stand 10 with two substantially L-shaped containment supports 11 and with two pairs of assemblies 12 installed at the side as cantilevers between the two containment supports 11; connection bodies connected by bolts or stay bolts are included at the base of the containment supports 11.

Figure 2:
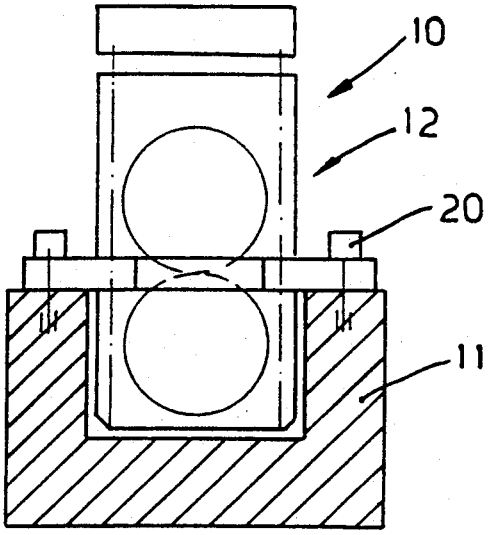
fig. 2 PRIOR ART

FIG. 2 is a side view of a rolling stand 10 with two substantially U-shaped containment supports 11 that bear and partially contain the two pairs of assemblies 12; in this example too the containment supports 11 are connected by connection bodies.

Figure 3:
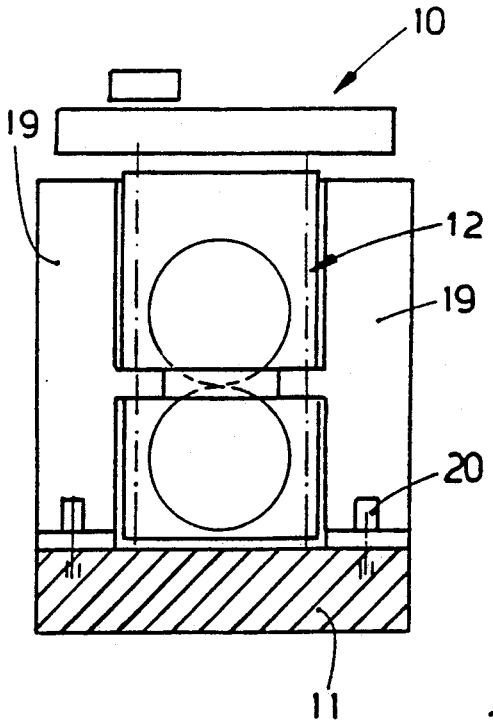
fig. 3 PRIOR ART

FIG. 3 is a side view of a rolling stand 10 with the containment supports 11 forming only an intermediate supporting and positioning element; the stand 10 includes two pairs of housings 19 that are connected to the containment support 11 by hydraulic stirrups 20.

The known containment supports 11 entail elements having a heavy weight to provide stability and require auxiliary processings to achieve their accurate coupling to the connection bodies; they also require a great number of clamping assemblies to obtain a safe connection between the various parts. They therefore involve a great waste of energy in their production.

Moreover, the known containment supports 11 do not succeed in clamping the chocks satisfactorily, so that during rolling there are undesirable movements of the various components of the stand 10 since the required rigidity is never achieved.

Furthermore, the known art requires long times for setting-up and assembly with resulting costs and is also burdened by excessive handling operations in the dismantling and re-assembly of the various components. It also requires auxiliary equipment for the assembly, dismantling and reciprocal positioning of the parts within a reasonable time.

Besides, two-high horizontal cartridge stands without containment supports already exist. Examples of these stands are disclosed in WO-A-88/06930 and JP-A-60 255 208 as well as in the information brochure of Danieli "Cartridge Stands", No.2000.03.86 of March 1986.

The end structures of these stands are installed for movement on rails and, when the rolls have to be replaced, are distanced from each other so as to enable a new assembly to be fitted.

This type of stand entails further problems of rigidity and stability as compared to stands provided with containment supports since the end structures of the stands are fully independent of each other; this leads to the fact that during rolling operations the rolling stresses transmitted by the rolls to the chocks and therefore to the end structures of the stands cause uncontrollable bending movements of those end structures and result in rolling defects.

The present invention has the main purpose of overcoming the defects and shortcomings typical of the state of the art and therefore of providing a two-high horizontal cartridge rolling stand without containment supports which ensure great stability and equally great rigidity.

This purpose is achieved owing to the embodiment of the features set forth in the main claim, while the dependent claims describe variants of the idea of the solution.

According to the invention a rolling stand 10 of a two-high horizontal type as shown in FIG. 3 but without a containment support is obtained.

The rigidity of the stand of the invention is provided by the union of a pair of housings by an equipment-holder bar, which is then connected to the other pair of housings in a removable manner.

This embodiment of the equipment-holder bar connected rigidly at one end to housings and connected in a removable manner to housings at its other end enables the stand to be opened for a speedy replacement of the rolling rolls.

According to the invention the pair of housings at one end of the stand 10 is made readily removable by unscrewing a plurality of suitable bolts.

According to another variant the two end structures of the stand are made independent of the central connecting body for constructional reasons, and one end structure is connected rigidly to the central body in a suitable stable manner by means of bolts.

The central connecting body includes also means to actuate and guide an equipment-holder slider.

The end structure of the stand stably connected to the central body comprises advantageously means to actuate and control the positioning of the slider.

The chocks at the side where the end structure is solidly fixed to the central body are made axially fixed to that end structure, so that the rolling stresses longitudinal to the rolling rolls are discharged onto that end structure.

The rolling stand according to the invention is removed from its base and is opened, for replacement of the rolls, on the side where the rolling rolls are clamped axially.

Figure 4:
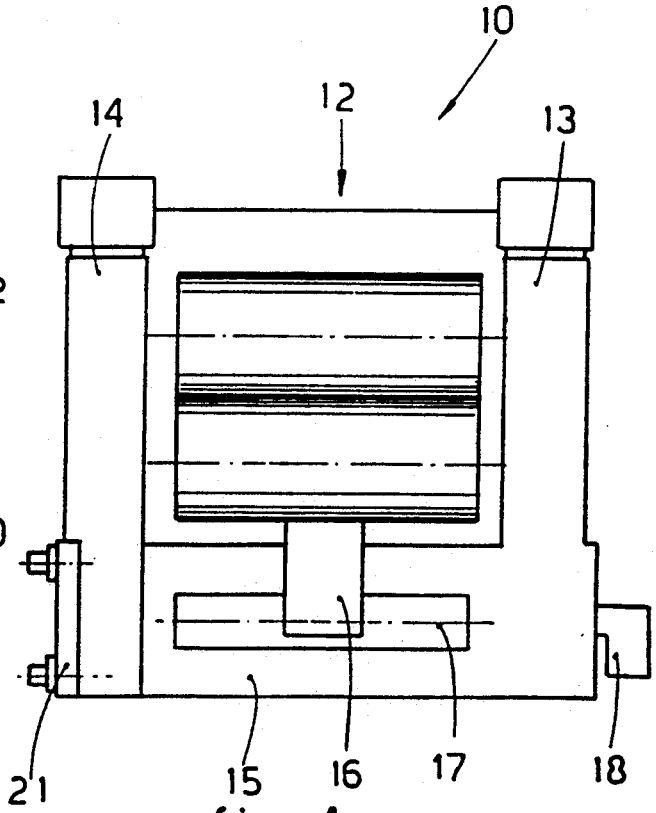

The attached FIGURES, which are given as a non-restrictive example, show the following:

FIG. 1 to 3 show the state of the art as described;

FIG. 4 gives a side view of the invention.

In FIG. 4 a rolling stand 10 comprises a first end structure 13 and a second end structure 14 which consist of pairs of housings, and comprises also a central body 15.

The second end structure 14 includes a heavy, independent, lateral connecting plate 21 to reinforce the housings, the plate 21 cooperating with the second end structure 14.

The two end structures 13–14 have the task of containing, supporting and positioning an assembly 12 of rolls, chocks and known means that adjust the distance between centres of the rolls.

In this case the second end structure 14 is processed independently of the central body 15, whereas the first end structure 13 is processed together with the central body 15.

The central body 15 performs also the task of an equipment-holder bar and forms a rigid connection between the two end structures 13–14 of the stand; it also acts as a supporting base of the stand 10.

This embodiment provides for an L-shaped body consisting of the first end structure 13 of the stand 10 and of a central body 15 that guides and positions the relative chocks in a direction lengthwise to the rolls, thereby creating a solid, stable anchorage in a direction lengthwise to the rolls.

The second end structure 14 is secured rigidly to the central body 15 by means of two or three bolts per side but can be readily removed therefrom; assembly takes place by lateral application of the second end structure 14 to the central body 15.

Appropriate undercuts, or guide and support surfaces, between the second end structure 14 and the central body 15 can be included to assist and improve positioning and reciprocal clamping.

Guides to position and guide an equipment-holder slider 16 are provided in the central body 15 above the two entry and exit sides (or only on the entry side). This slider 16 is moved and positioned lengthwise to the rolls by threaded rods 17, which can be actuated by hand or even by an automated control means 18.

The second end structure 14 of the stand can be clamped laterally to the central body 15.

The invention eliminates a containment support 11 and increases the axial and transverse rigidity of the stand 10 as compared to known stands that do not comprise a containment support.

According to the invention the chocks of the first end structure 13 are secured lengthwise to the rolls, whereas the chocks of the second end structure 14 are free in a direction lengthwise to the rolls.

I claim:

1. Two-high horizontal cartridge rolling stand which comprises an assembly including rolls, chocks and adjustment means arranged between an L-shaped first end structure and a second end structure of the stand and is characterized in that a position of the L-shaped first end structure forms a central stiffening body positioned laterally below the rolls for connection with the second end structure by releasable fixture means which provide momentary rigid and substantially stable connection of the second end structure to the central body, the first end structure of the stand also constraining the chocks in a direction lengthwise to the rolling rolls.

2. Stand as claimed in claim 1, in which the releasable fixture means comprise a heavy, rigid connecting plate that cooperates with the second end structure and can be fixed to the second end structure and the central body by means of bolts.

3. Stand as claimed in claim 2, in which the central body comprises guides to position and guide an equipment-holder slider.

4. Stand as claimed in claim 3, in which the central body comprises threaded means to position the slider lengthwise to the rolls.

5. Stand as claimed in claim 4, in which means to actuate the threaded means are included in the first end structure of the stand.

* * * * *